US009286756B2

(12) United States Patent
Bramble

(10) Patent No.: US 9,286,756 B2
(45) **Date of Patent: *Mar. 15, 2016**

(54) METHOD OF GAMING, A GAME CONTROLLER AND A GAMING SYSTEM

(71) Applicant: Aristocrat Technologies Australia Pty Limited, North Ryde, NSW (AU)

(72) Inventor: Paul Francis Jason Bramble, Leumeah (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/737,378

(22) Filed: Jan. 9, 2013

(65) Prior Publication Data

US 2013/0122985 A1 May 16, 2013

Related U.S. Application Data

(63) Continuation of application No. 12/402,219, filed on Mar. 11, 2009, now Pat. No. 8,371,933.

(30) Foreign Application Priority Data

Mar. 11, 2008 (AU) ..... 2008901142

(51) Int. Cl.
*A63F 9/24* (2006.01)
*G07F 17/32* (2006.01)

(52) U.S. Cl.
CPC ..... *G07F 17/3244* (2013.01); *G07F 17/32* (2013.01); *G07F 17/3232* (2013.01); *G07F 17/3288* (2013.01)

(58) Field of Classification Search
CPC ..... G07F 17/3244; G07F 17/3288
USPC ..... 463/1–25
See application file for complete search history.

(56) References Cited

U.S. PATENT DOCUMENTS

| | | | |
|---|---|---|---|
| 4,371,872 | A | 2/1983 | Rossman |
| 6,165,070 | A | 12/2000 | Nolte |
| 7,322,885 | B1 | 1/2008 | Luciano, Jr. |
| 2002/0137560 | A1 | 9/2002 | Demar |
| 2002/0142823 | A1 | 10/2002 | Demar |
| 2003/0104857 | A1 | 6/2003 | Jenkins |
| 2003/0199307 | A1 | 10/2003 | Demar |
| 2003/0199309 | A1 | 10/2003 | Demar |
| 2004/0102241 | A1 | 5/2004 | Kaminkow |
| 2005/0187011 | A1 | 8/2005 | Kaminkow |
| 2006/0058103 | A1 | 3/2006 | Danieli |
| 2007/0099693 | A1 | 5/2007 | Nakashima |
| 2007/0129129 | A1 | 6/2007 | Tinghitella |
| 2007/0155497 | A1 | 7/2007 | Okada |

(Continued)

FOREIGN PATENT DOCUMENTS

| | | |
|---|---|---|
| AU | 2008200094 | 7/2008 |
| CA | 2551794 | 6/2006 |

(Continued)

*Primary Examiner* — Vongsavanh Sengdara
(74) *Attorney, Agent, or Firm* — McAndrews, Held & Malloy, Ltd.

(57) ABSTRACT

A method of gaming comprising: receiving an input indicative that a player accepts deferred payment in respect of at least one award awardable during play of a game; conducting the play to determine whether the at least one award is made; and providing an entitlement to the player to enable the player to obtain the award after a deferment period when the award is made to the player.

30 Claims, 6 Drawing Sheets

(56) References Cited

U.S. PATENT DOCUMENTS

| | | | | |
|---|---|---|---|---|
| 2007/0173323 | A1 | 7/2007 | Johnson | |
| 2007/0191125 | A1 | 8/2007 | Minard | |
| 2007/0213132 | A1 | 9/2007 | Chilton | |
| 2007/0265060 | A1 | 11/2007 | Hornik et al. | |
| 2008/0026816 | A1 | 1/2008 | Sammon et al. | |
| 2008/0176649 | A1* | 7/2008 | Sakuma | G07F 17/32 463/27 |

FOREIGN PATENT DOCUMENTS

| | | |
|---|---|---|
| CA | 2595161 | 1/2008 |
| CN | 1968210 | 5/2007 |
| DE | 3912640 | 10/1990 |
| DE | 202005005719 | 7/2005 |
| DE | 102004004035 | 8/2005 |
| DE | 102004004036 | 8/2005 |
| DE | 102005063078 | 7/2007 |
| GB | 1268821 | 3/1972 |
| JP | 2005094759 | 4/2005 |
| JP | 2007236709 | 9/2007 |
| WO | 0012186 | 3/2000 |
| WO | 2006002241 | 1/2006 |
| WO | 2006094399 | 9/2006 |
| WO | 2007032954 | 3/2007 |
| WO | 2007081310 | 7/2007 |
| WO | 2007098117 | 8/2007 |

* cited by examiner

METHOD OF GAMING, A GAME CONTROLLER AND A GAMING SYSTEM

RELATED APPLICATIONS

This application is a continuation of, and claims priority to, U.S. patent application Ser. No. 12/402,219, having a filing date of Mar. 11, 2009, which claims priority to Australia Provisional Patent Application No. 2008901142, having a filing date of Mar. 11, 2008, both of which are incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

In current gaming systems, the focus has been on controlling the return to the player to ensure that the return that is provided meets the regulatory minimum return to player (RTP).

Some venues increase the return to player above the regulatory minimum as a method of competing within the marketplace. As a result they obtain a lower return on turnover. It would be advantageous to provide an increased return to player to players at a lower cost to the venue.

BRIEF SUMMARY OF THE INVENTION

In a first aspect, the invention provides a method of gaming comprising:

- receiving an input indicative that a player accepts deferred payment in respect of at least one award awardable during play of a game;
- conducting the play to determine whether the at least one award is made; and
- providing an entitlement to the player to enable the player to obtain the award after a deferment period when the award is made to the player.

In an embodiment, the input indicates that the player accepts deferred payment in respect of all awards awardable during play of the game.

In an embodiment, the input indicates that the player accepts deferred payment in respect of a subset of all awards awardable during play of the game.

In an embodiment, the received input specifies one of at least two possible deferment periods and different awards apply to each deferment period.

In an embodiment, the method comprises offering the player the option to select between at least two different inputs at least one of which corresponds to deferred payment of at least one award, and at least one of which corresponds to immediate payment of all awards.

In an embodiment, the method comprises providing at least one additional benefit to a player when the player accepts deferred payment.

In an embodiment, the method comprises providing the benefit in the form of an increased award amount related to the deferment period.

In an embodiment, the method comprises providing the benefit in the form of at least one alteration to the rules of the game.

In an embodiment, the method comprises altering the pay table.

In an embodiment, the method comprises altering the probability of one or more outcomes of a play of the game.

In an embodiment, the method comprises providing at least one additional feature not available for non-deferred payment.

In an embodiment, the method comprises storing the entitlement as data associated with a player account.

In an embodiment, the method comprises providing the player with a token corresponding to the entitlement.

In an embodiment, the input is received prior to or as part of initiating a play of the game.

In a second aspect, the invention provides a game controller for a gaming system, the game controller arranged to:

- determine from a player input that a player accepts deferred payment in respect of at least one award awardable during play of a game;
- conduct the play to determine whether the at least one award is made; and
- provide an entitlement to the player to enable the player to obtain the award after a deferment period when the award is made to the player.

In an embodiment, the game controller is arranged to determine from the input whether the player accepts deferred payment in respect of all awards awardable during play of the game.

In an embodiment, the game controller is arranged to determine from the input whether the player accepts deferred payment in respect of a subset of all awards awardable during play of the game.

In an embodiment, the game controller is arranged to determine from the input, one of at least two possible deferment periods and different awards apply to each deferment period.

In an embodiment, the game controller is arranged to offer the player the option to select between at least two different inputs at least one of which corresponds to deferred payment of at least one award, and at least one of which corresponds to immediate payment of all awards.

In an embodiment, the game controller is arranged to provide at least one additional benefit to a player when the player accepts deferred payment.

In an embodiment, the game controller is arranged to provide the benefit in the form of an increased award amount related to the deferment period.

In an embodiment, the game controller is arranged to provide the benefit in the form of at least one alteration to the rules of the game.

In an embodiment, the game controller is arranged to alter the pay table.

In an embodiment, the game controller is arranged to alter the probability of one or more outcomes of a play of the game.

In an embodiment, the game controller is arranged to provide at least one additional feature not available for non-deferred payment.

In an embodiment, the game controller comprises a win meter for at least temporarily storing win amounts during normal play and a deferred win meter for at least temporarily storing win amounts during deferred payment play.

In an embodiment, the game controller comprises a meter controller for selectively activating the win meter or deferred win meter based on the received input.

In an embodiment, the game controller comprises an entitlement generator arranged to generate an entitlement based on one or more awards made during deferred payment play.

In an embodiment, the entitlement generator is arranged to store the entitlement as data associated with a player account.

In an embodiment, the entitlement generator is arranged to generate a token corresponding to the entitlement to provide to the player.

In an embodiment, the game controller is constituted, at least in part, by a processor arranged to execute code stored in a memory.

In a third aspect, the invention provides a gaming system comprising:

a game play mechanism operable by a player to make an input indicative that the player accepts deferred payment in respect of at least one award awardable during play of a game; and a game controller arranged to:

receive the input indicative that the player accepts deferred payment;

conduct the play to determine whether the at least one award is made; and generate an entitlement for the player to enable the player to obtain the award after a deferment period when the award is made to the player.

In an embodiment, the game play mechanism is operable to enable the player to make an input which indicates whether the player accepts deferred payment in respect of all awards awardable during play of the game.

In an embodiment, the game play mechanism is operable to enable the player to make an input which indicates whether the player accepts deferred payment in respect of a subset of all awards awardable during play of the game.

In an embodiment, the game play mechanism is operable to enable the player to make an input which indicates one of at least two possible deferment periods and the game controller applies different awards for each deferment period.

In an embodiment, the gaming system is arranged to offer the player the option to select between at least two different inputs at least one of which corresponds to deferred payment of at least one award, and at least one of which corresponds to immediate payment of all awards.

In an embodiment, the game controller is arranged to provide at least one additional benefit to a player when the player accepts deferred payment.

In an embodiment, the game controller is arranged to provide the benefit in the form of an increased award amount related to the deferment period.

In an embodiment, the game controller is arranged to provide the benefit in the form of at least one alteration to the rules of the game.

In an embodiment, the game controller is arranged to alter a pay table.

In an embodiment, the game controller is arranged to alter the probability of one or more outcomes of a play of the game.

In an embodiment, the game controller is arranged to provide at least one additional feature not available for non-deferred payment.

In an embodiment, the gaming system comprises a win meter for at least temporarily storing win amounts during normal play and a deferred win meter for at least temporarily storing win amounts during deferred payment play.

In an embodiment, the game controller comprises a meter controller for selectively activating the win meter or deferred win meter based on the received input.

In an embodiment, the game controller comprises an entitlement generator arranged to generate an entitlement based on one or more awards made during deferred payment play.

In an embodiment, the entitlement generator is arranged to store the entitlement as data associated with a player account.

In an embodiment, the entitlement generator is arranged to generate a token corresponding to the entitlement to provide to the player.

In an embodiment, the game controller is constituted, at least in part, by a processor arranged to execute code stored in a memory.

In a fourth aspect, the invention provides computer program code which when executed implements the above method.

In a fifth aspect, the invention provides a computer readable medium comprising the above program code.

In a sixth aspect, the invention provides a data signal comprising the above program code.

In a seventh aspect, the invention extends to transmitting the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
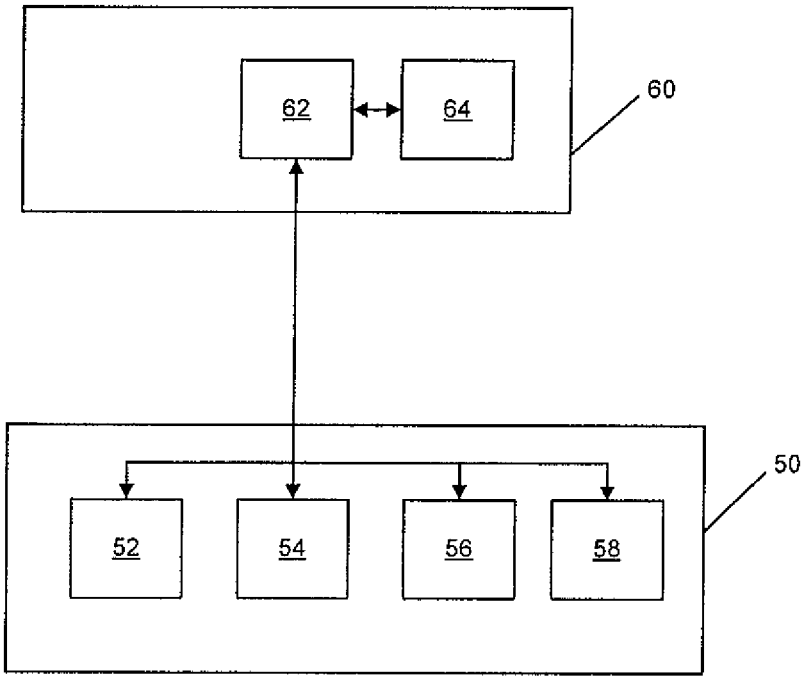
FIG. 1 is a block diagram of the core components of a gaming system.

Referring to the drawings, there is shown a gaming system having a game controller arranged to implement a game where the player can indicate they accept deferred payment. In some embodiments where players can specify deferred or immediate payment, players who accept deferred payment obtain a higher return to player.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54, a game play mechanism 56 comprising one or more input devices that enable a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
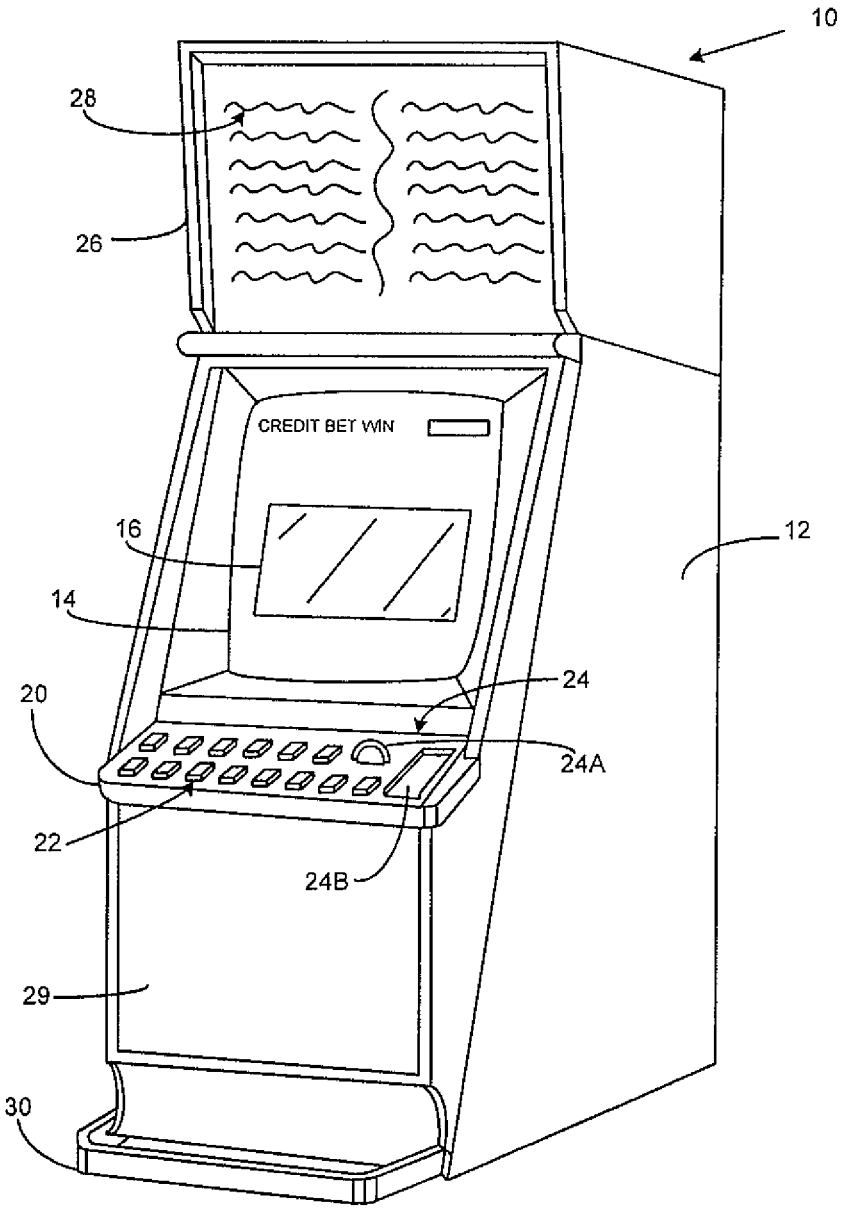
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
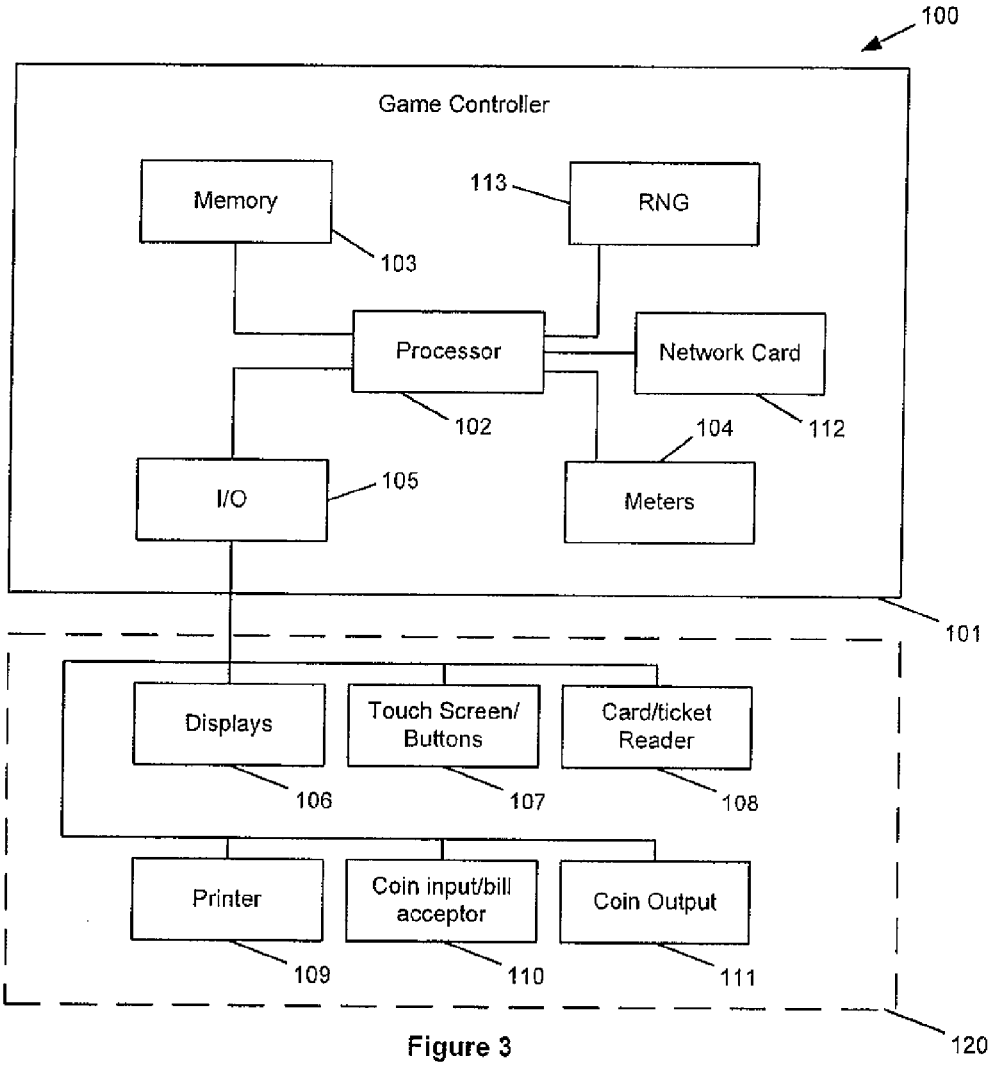
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is uses to initiate a play of the game.

In addition, the gaming machine 100 may include a communications interface, for example a network card 112. The network card may, for example, send status information, accounting information or other information to a central controller, server or database and receive data or commands from the central controller, server or database.

Figure 4:
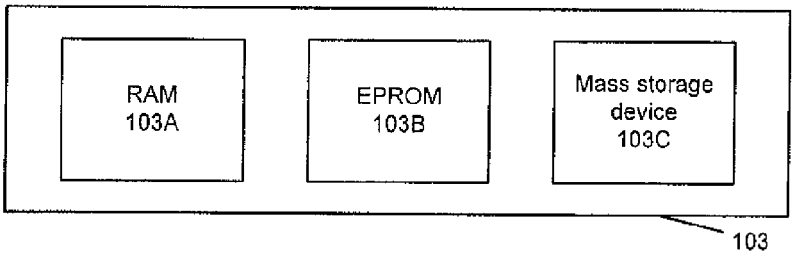
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
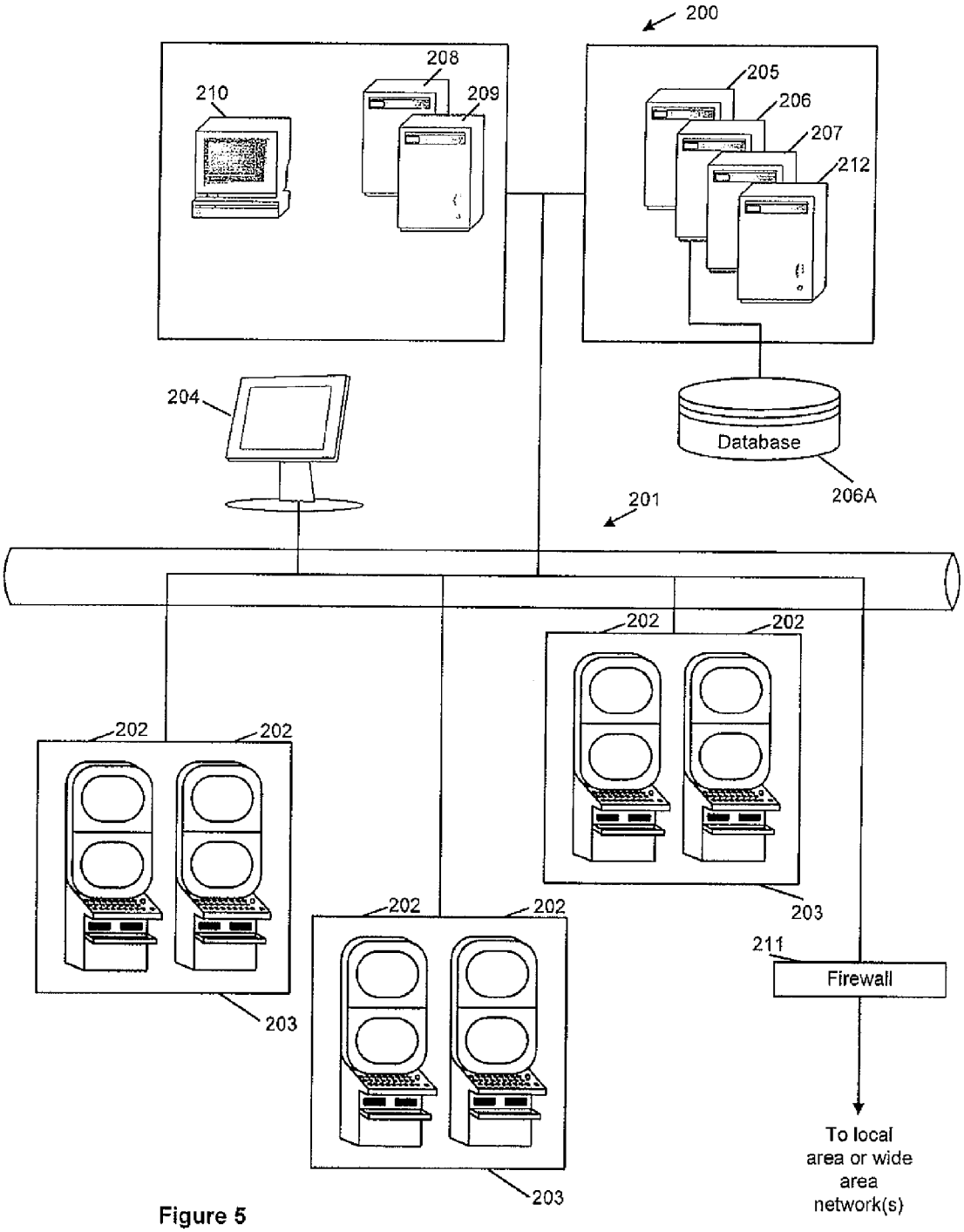
FIG. 5 is a schematic diagram of a network gaming system.
Figure 6:
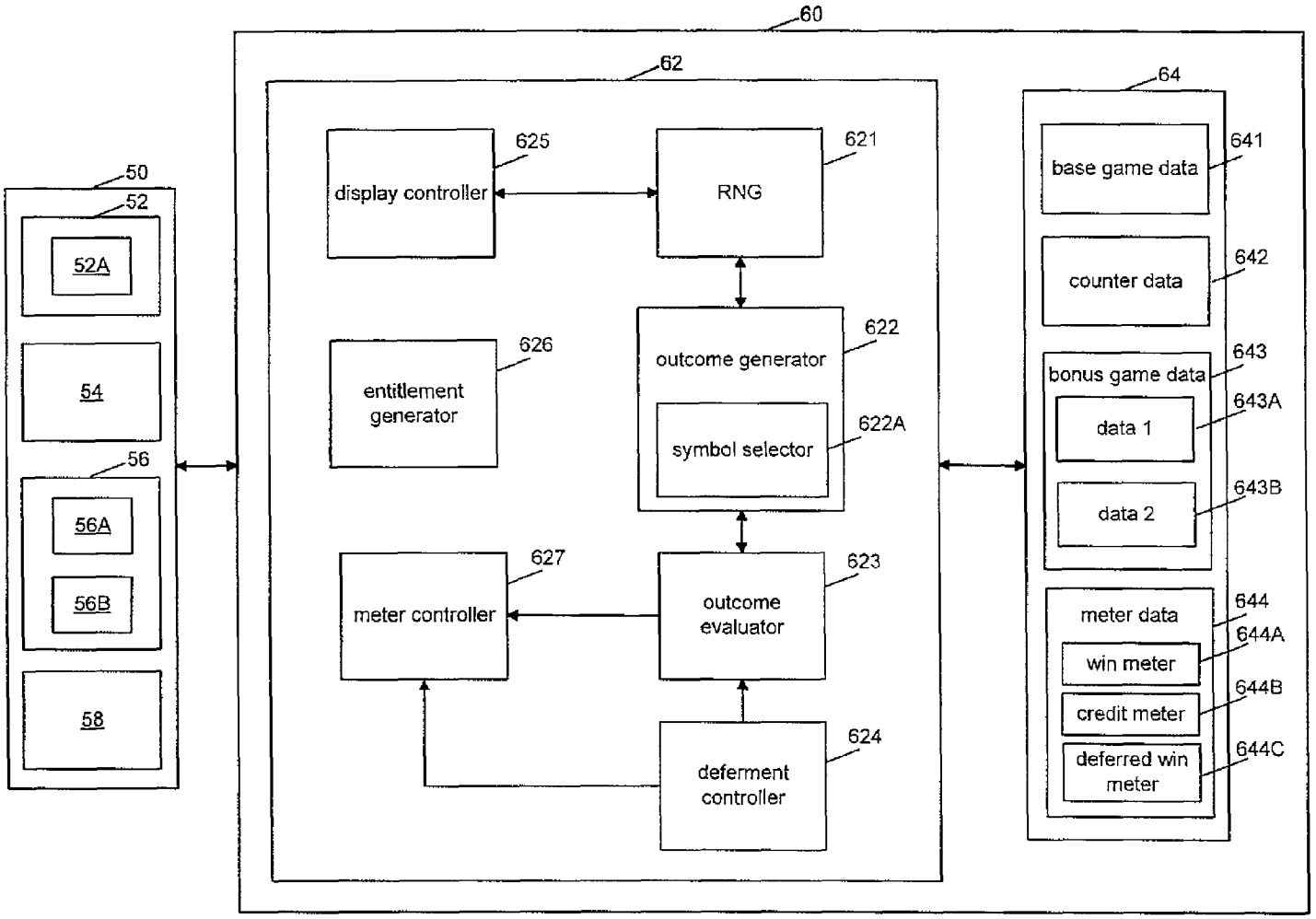
FIG. 6 is a further block diagram of a gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

Persons skilled in the art will appreciate that a player's win entitlement will vary from game to game. In this embodiment, part of obtaining a win entitlement is effected by the player operating game play mechanism 56 to make a selection of either, a normal immediate return 56A or to indicate that the player accepts deferred payment 56B. Typically, the player's win entitlement lasts for a play of the game. Depending on the specific implementation, the length of a play may be fixed (e.g. a single spin of reels of a spinning reel game) or variable (e.g. may include any free games awarded). The play ends when nothing further can occur to affect the outcome. In the prior art, this is when credits resulting from any wins are transferred from the win meter to the credit meter. By deferring payment an interest rate can be applied to the win to increase the prize.

In a typical implementation, the player will need to make further selections by operating the game play mechanism in order to establish their win entitlement. For example, in most spinning reel games, it is typical for the player's entitlement to be affected by the amount they wager and selections they make (i.e. the nature of the wager). For example, a player's win entitlement may be based on how many lines they will play in each game—i.e. a minimum of one line up to the maximum number of lines allowed by the game (noting that not all permutations of win lines may be available for selection. Such win lines are typically formed by a combination of displayed symbol positions, one from each reel, the symbol positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons skilled in the art, will appreciate that in other embodiments, the player may obtain a win entitlement by selecting a number of reels to play. Such games are marketed under the trade name "Reel Power" by Aristocrat Leisure Industries Pty Ltd. The selection of the reel means that each selected symbol of the reel can be substituted for a symbol at one or more designated display positions. In other words, all displayed symbol positions of a selected reel can be used to form symbol combinations with designated, displayed symbol positions of other reels.

In other embodiments a player win entitlement may be affected by purchasing access to particular pay tables—e.g. a first bet amount entitles the player to wins including cherries and a second amount entitles them to wins including plums. The win entitlement is not always purchased—e.g. a series of free games may be awarded.

The outcome generator 622 operates in response to the player's operation of game play mechanism 56 to generate a game outcome which will then be evaluated by outcome evaluator 623. If the player selects 56A normal, immediate payment, the deferment controller 624 controls outcome evaluator 623 to employ a first set of prize data 643A of prize data 643 stored in memory 64. If the player selects 56B deferred payment, the deferment controller 624 controls outcome evaluator 623 to employ a second set of prize data 643B of prize data 643 stored in memory 64. The second set of prize data 643B has higher prize amounts for each item in the pay table but each payment is deferred. That is, the same symbol combinations are in each pay table in this embodiment but higher awards are assigned in the second set 643B.

The game outcome generator 622A employs symbol selector 622A to select symbols from a set of symbols specified by symbol data 642 employing random number generator 621. The selected symbols are advised to the display controller 624 which causes them to be displayed on display 54 at a set of display positions.

One example of selecting symbols is for the symbol selector 622A to select symbols for display from a plurality of symbol sets corresponding to respective ones of a plurality of spinning reels. The symbol sets 641 can specify a sequence of symbols for each reel such that the symbol selector 622A can select a symbol by selecting a stopping position in the sequence. In one example, three symbols of each of five reels may be displayed such that symbols are displayed at fifteen display positions on display 54.

In the embodiment, after the symbols are displayed, the outcome evaluator 623 determines whether they correspond to a prize in prize data 643. The game controller 60 determines based on game rules 642 whether any further game outcomes need to be generated; for example if the game rules specify that three scattered, designated symbols trigger a free game sequence, and the symbols are in the game outcome. If further outcomes are to be generated, these are generated and evaluated by the outcome generator 622 and outcome evaluator 623 respectively. During play, a win meter 644A stored as meter data 644 is updated with any wins.

Depending on whether the player elects normal 56A or deferred payment, the deferment controller 624 sets the meter controller 627 to update the appropriate one of the credit meter 644B or the deferred win meter 644C at the conclusion of play. When a player cashes out, any credits in the credit meter 644B are paid out in the usual manner whereas if the deferred win meter contains any credits entitlement generator 626 generates an entitlement specifying the number of credits won and the deferment period. In the embodiment, the entitlement is printed in the form of a ticket, specifying the number of credits, their currency equivalent and when the ticket can be redeemed.

It will be appreciated that the entitlement could be provided on another form of token or by associating data with a player account, maintained for example, in conjunction with the loyalty program by loyalty program server 212. In the latter case, deferred wins could be made accessible automatically at the conclusion of the deferment period.

Figure 7:
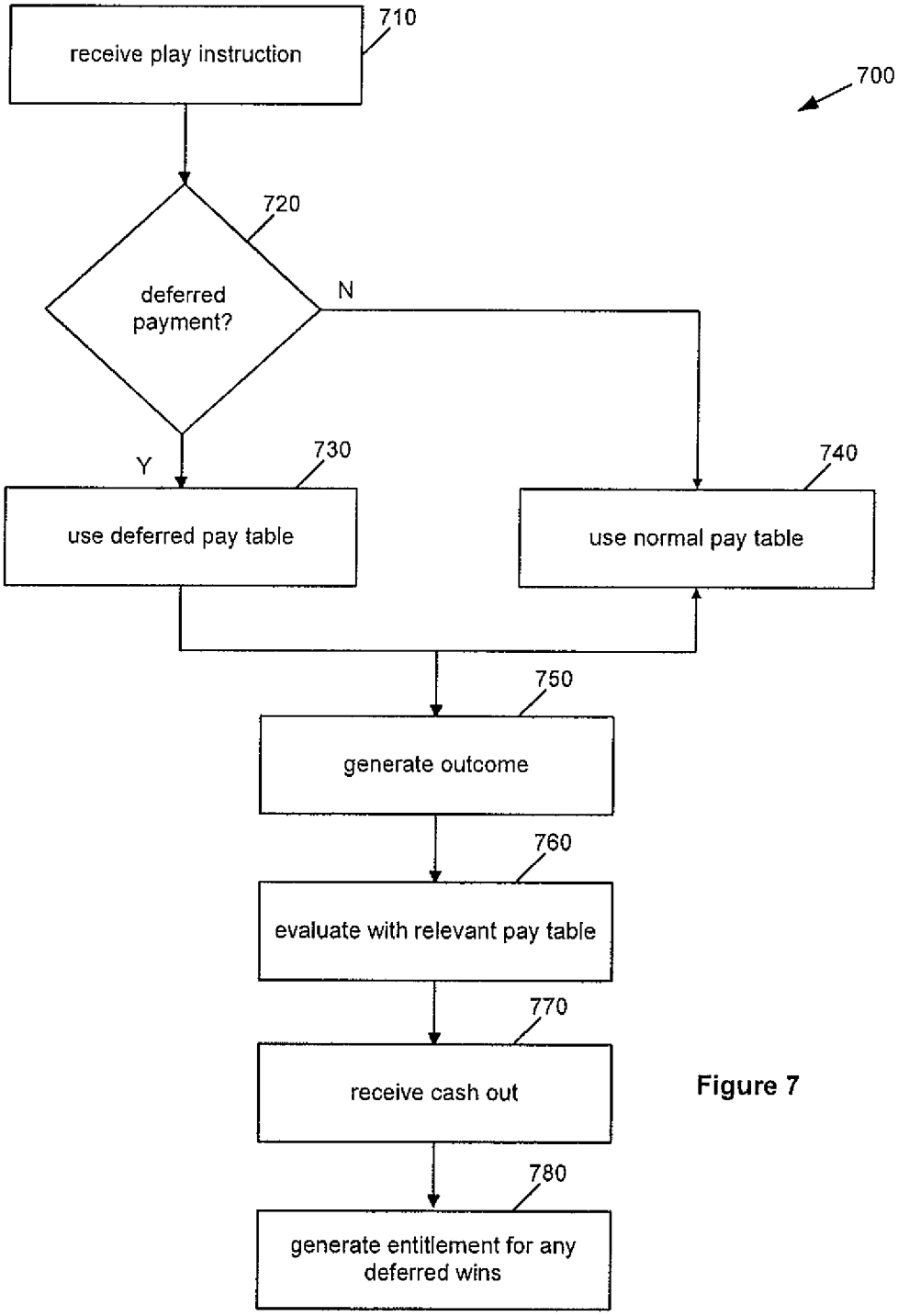
FIG. 7 is a flow chart of an embodiment.

The method 700 is summarized in FIG. 7 and involves receiving 710 a play instruction and determining 720 whether or not deferred payment is accepted. If deferred payment is accepted, a deferred payment pay table is used 730; otherwise, a normal pay table is used 740. Outcomes are generated 750 and evaluated 760 with deferred wins stored in a deferred win meter. When a player cashes out 770, an entitlement is generated 780 for the deferred wins.

Persons skilled in the art will also appreciate that the method of the embodiment could be embodied in program code. The program code could be supplied in a number of ways, for example on a computer readable medium, such as a disc or a memory (for example, that could replace part of memory 103) or as a data signal (for example, by downloading it from a server).

Alternative Embodiments

The game can be configured to a variety of return to player percentages each corresponding to the amount of time by which the payment is deferred. That is, the player may be able to select the length of the deferment period.

In one embodiment, all pays are deferred and this is advised to the player in advance—i.e. that all pays of this gaming machine are deferred.

In the above embodiment, the return to player is adjusted by marking up all items in the pay table. In some embodiments, depending on the increased return provided by deferred payment and the nature of the pay table, it may be convenient to adjust individual items of the pay table to achieve the desired increased return to player. For example, so that each item in the pay table is expressed in a round number of credits.

In other embodiments more complicated methods of providing the adjustment to the return to player are provided by including an increase in win probability or a combination of increase in pay size and win probability. For example, there may be differing pay tables corresponding to different deferment years and/or differing reel strips corresponding to different deferment years—i.e. different symbol data may be employed to adjust the probability. Other alternatives include changes in the rules, which may include a change in evaluation, for instance wins may be left to right for immediate payment (0 years deferment) but they may pay any for a 5 year deferment. In one embodiment, the rules are altered corresponding to the deferment selected; for example, the number of free games in a feature game could be 5, 10, 15, 20 or 25 for deferment years 1, 2, 3, 4 or 5 respectively.

Deferment may only be in respect of certain awards, e.g. prizes above a threshold. In embodiments, where the rules of the game are altered, the deferment may apply in respect of prizes which become available by virtue of the altered rules. For example, the deferment may entitle the player to a feature not normally available to players and the deferment may only apply to awards from the additional feature. the provision of an additional feature, is another way of increasing the return to player.

EXAMPLE

In the example, payment of wins may be made immediately (a zero year deferment) or deferred for 1 to 5 years. For example, a win of 100 credits may be deferred for 1 year after which a payment of 105 credits may be awarded at 5% p.a. (compounded annually). At this rate the same 100 credits payment deferred for 5 years at 5% p.a. after results in an eventual payment of 127 credits. In the example, there is an underlying credit return of 90% return to player. Any deferred wins due to adjustments made by selecting the deferment are accumulated in the deferred win meter. This way the underlying credit turnover can be maintained at the below 100% rate at which credits are expected to diminish in favor of the club/host of the machine. This credits return may change with a change in deferment rate.

In this way a standard game of 90% return could be altered as indicated in Table 1.

TABLE 1

| Deferment | Credits Return | Deferred Return | Total Return |
|---|---|---|---|
| 0 years | 90.00% | 0.00% | 90.00% |
| 1 years | 90.00% | 4.50% | 94.50% |
| 2 years | 90.00% | 9.23% | 99.23% |
| 3 years | 90.00% | 14.19% | 104.19% |
| 4 years | 90.00% | 19.40% | 109.40% |
| 5 years | 90.00% | 24.87% | 114.87% |

It will be understood to persons skilled in the art of the invention that many modifications may be made without departing from the spirit and scope of the invention. In particular, that features described above in different contexts can be employed to form further embodiments.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of gaming for use with a gaming system having a) a game controller and b) a predefined return-to-player (RTP), the method of gaming comprising:

providing via the game controller an option to defer payment in respect of an award awardable during a play of a game, the option including enabling a selection of a length of a deferment period;

receiving via the game controller an input indicative of the selected length of deferment period;

applying via the game controller one of a plurality of predefined entitlements, each of the plurality of predefined entitlements being associated with a length of the deferment period, wherein the value of each predefined entitlement alters said predefined RTP such that selecting a non-zero length of deferment period results in an adjusted RTP that is higher than said predefined RTP;

conducting via the game controller the play to determine whether the award is made; and providing via the game controller the applied said one of a plurality of predefined entitlements to enable a receipt of the award after the deferment period when the award is payable.

2. A method as claimed in claim 1, and wherein the input indicates a player acceptance of a deferred payment in respect of all awards awardable during play of the game.

3. A method as claimed in claim 1, and wherein the input indicates a player acceptance of a deferred payment in respect of a subset of all awards awardable during play of the game.

4. A method as claimed in claim 1, and wherein the received input specifies one of at least two possible deferment periods and different awards applicable to each deferment period.

5. A method as claimed in claim 1, and further comprising offering the option to select between at least two different inputs at least one of which corresponds to a deferred payment of the award, and at least one of which corresponds to an immediate payment of all awards.

6. A method as claimed in claim 1 and further comprising providing at least one additional benefit when a deferred payment is accepted.

7. A method as claimed in claim 6, and further comprising providing the benefit in the form of an increased award amount related to the deferment period.

8. A method as claimed in claim 6, and further comprising providing the benefit in the form of at least one alteration to the rules of the game.

9. A method as claimed in claim 8, and further comprising altering a pay table of the game.

10. A method as claimed in claim 8, and further comprising altering a probability of one or more outcomes of a play of the game.

11. A method as claimed in claim 8, and further comprising providing at least one additional feature not available for a non-deferred payment.

12. A method as claimed in claim 1, and further comprising storing the entitlement as data associated with a player account.

13. A method as claimed in claim 1, and further comprising providing a token corresponding to the entitlement.

14. A method as claimed in claim 1, and wherein the input is received prior to or as part of initiating a play of the game.

15. A game controller for a gaming system having a predefined return-to-player (RTP), the game controller configured to:

provide an option to a player to defer payment in respect of an award awardable during a play of a game, the option including enabling the player to select a length of a deferment period;

receive an input indicative of the selected length of deferment period;

apply one of a plurality of predefined entitlements, each predefined entitlement being associated with a length of the deferment period, wherein the value of each predefined entitlement alters said predefined RTP such that selecting a non-zero length of deferment period results in an adjusted RTP that is higher than said predefined RTP;

conduct the play to determine whether the award is made; and provide the applied said one of a plurality of predefined entitlements to the player to enable the player to obtain the award after the deferment period when the award is payable to the player.

16. A game controller as claimed in claim 15, and configured to determine from the input whether the player accepts a deferred payment in respect of all awards awardable during play of the game.

17. A game controller as claimed in claim 15, and configured to determine from the input whether the player accepts a deferred payment in respect of a subset of all awards awardable during play of the game.

18. A game controller as claimed in claim 15, and configured to determine from the input, one of at least two possible deferment periods and different awards applicable to each deferment period.

19. A game controller as claimed in claim 15, and configured to offer the player the option to select between at least two different inputs at least one of which corresponds to a deferred payment of at least one award, and at least one of which corresponds to an immediate payment of all awards.

20. A game controller as claimed in claim 15, and configured to provide at least one additional benefit to a player when the player accepts a deferred payment.

21. A game controller as claimed in claim 20, and configured to provide the benefit in the form of an increased award amount related to the deferment period.

22. A game controller as claimed in claim 20, and configured to provide the benefit in the form of at least one alteration to the rules of the game.

23. A game controller as claimed in claim 22, and configured to alter a pay table of the game.

24. A game controller as claimed in claim 23, and configured to provide at least one additional feature not available for a non-deferred payment.

25. A game controller as claimed in claim 22, and configured to alter a probability of one or more outcomes of a play of the game.

26. A game controller as claimed in claim 15, and further comprising a win meter configured at least temporarily to store win amounts during normal play and a deferred win meter for at least temporarily storing win amounts during deferred payment play.

27. A game controller as claimed in claim 26, and further comprising a meter controller configured selectively to activate the win meter or deferred win meter based on the received input.

28. A game controller as claimed in claim 15, and further comprising an entitlement generator configured to generate an entitlement based on one or more awards made during deferred payment play.

29. A game controller as claimed in claim 28, and wherein the entitlement generator is configured to store the entitlement as data associated with a player account.

30. A game controller as claimed in claim 28, and wherein the entitlement generator is configured to generate a token corresponding to the entitlement to provide to the player.

* * * * *